United States Patent [19]

Kishino

[11] 3,986,760

[45] Oct. 19, 1976

[54] METHOD FOR MANUFACTURING A MULTI-DIGIT FLUORESCENT INDICATING APPARATUS

[75] Inventor: Takao Kishino, Mobara, Japan

[73] Assignee: Futuba Denshi Kogyo Kabushiki Kaisha, Japan

[22] Filed: Sept. 26, 1974

[21] Appl. No.: 509,716

[30] Foreign Application Priority Data

Jan. 25, 1974 Japan ..... 49-1011049

[52] U.S. Cl. ..... 316/19; 29/25.16

[51] Int. Cl.[2] ..... H01J 9/18

[58] Field of Search ..... 316/19.20; 29/25.15, 29/25.16, 25.17; 313/497, 496, 519, 520

[56] References Cited

UNITED STATES PATENTS

| | | | |
|---|---|---|---|
| 3,567,989 | 3/1971 | Koshizuka et al. | 313/310 |
| 3,675,065 | 7/1972 | Warne | 313/519 |
| 3,747,175 | 7/1973 | Uemura et al. | 29/25.17 |
| 3,787,940 | 1/1974 | Kupsky | 29/25.16 |
| 3,800,178 | 3/1974 | Farina | 313/497 |
| 3,836,806 | 9/1974 | Kobayakawa | 313/497 |
| 3,849,694 | 11/1974 | Harvey | 313/519 |
| 3,862,476 | 1/1975 | Kuchinsky et al. | 29/25.16 |
| 3,902,003 | 8/1975 | Wheeler et al. | 313/519 |

*Primary Examiner*—Richard B. Lazarus
*Attorney, Agent, or Firm*—Oblon, Fisher, Spivak, McClelland & Maier

[57] ABSTRACT

A multi-digit fluorescent indicating apparatus and a manufacturing method therefor are disclosed. The indicating apparatus includes an enclosure, formed by sealing a base plate and an upper surface window plate together, and containing one or more segmented electrodes of fluorescent material coated on the base plate. In the manufacturing method, various lead-in wires for grids and cathodes as well as spacers for grids are formed from a single metal plate, facilitating easy connection to external circuits and improving compactness lightness and reliability as well as reducing manufacturing costs.

7 Claims, 9 Drawing Figures

METHOD FOR MANUFACTURING A MULTI-DIGIT FLUORESCENT INDICATING APPARATUS

BACKGROUND OF THE INVENTION

1. Field of the Invention

This invention relates generally to a plane type multi-digit fluorescent indicating apparatus for use in, for example, small electronic calculators and to a method of manufacture thereof.

2. Description of the Prior Art

There are various conventional structures for multi-digit fluorescent indicator tubes and multi-digit fluorescent indicating apparatuses (hereinafter called indicating apparatuses). The pattern indicating portion of these tubes, comprises a group of segmented electrodes, on which the fluorescent material is deposited, disposed on a base plate composed of insulating material, such as ceramic for example. The indicator electrode assembly is formed by disposing a grid and a cathode opposing the pattern indicating portion. Then, the indicator electrode assembly is put inside an enclosure such as a cylindrical glass tube, or an enclosure formed by hermetically sealing together two base plates, one of which includes a transparent window portion and which may be shaped like an inverted flat-bottom boat. A stem portion having hermetically sealed lead-in wires passing through may also be provided on at least one end thereof. In such a conventional structure, the indicator electrode assembly normally has a plural number pattern indicating portion, and the stem portion is formed separately after combining and connecting the components together. Therefore, these conventional devices are extremely complicated due to many internal connecting wires being required in a congested enclosure. Furthermore, in conventional devices minimization of dimensions is difficult and the labour necessary for assembly and making internal connections is extensive. Furthermore, there is a difficulty in that adequate reliability could not be maintained due to the large number of internal connections made by welding.

In order to overcome the aforementioned problems in the conventional apparatus, the indicating apparatus disclosed in U.S. application Ser. No. 307,368 filed Nov. 17, 1972, now abandoned has been proposed. This apparatus is illustrated in FIGS. 1 and 2.

In FIGS. 1 and 2, a print base plate 1*a* is formed by depositing on a base plate 1, composed of insulating material such as glass or ceramic, conductive films forming electric connecting wirings 3, lead-in wires 4 and terminals 5. The conductive film is covered with an insulating film 6 which is provided with a plurality of holes for permitting the connecting wires 3 to communicate with each of segmented electrodes 2*a*–2*h*. An anode pattern indicating portion is formed by depositing a fluorescent material 7 on the segmented electrode 2*a*–2*h*. Plural grids 8 and cathodes 9, emitting thermal electrons, are positioned opposite each group of the segmented electrodes 2*a*–2*h*, and are connected to the connecting wire 3 by a conductive adhesive agent 10 and secured to print base plate 1*a*. These portions of the electrodes on the base plate are installed inside an evacuated air tight enclosure comprising the print base plate 1*a* and an upper surface window plate 11 sealed to the upper surface of the base plate. In addition, the terminals 5 are printed on the base plate 1*a* for connection to outside circuits and are positioned outside the enclosure. In other words, the conductive films of connecting wires formed on base plate 1 are extended to the outside of the enclosure as the terminals for each electrode.

In the indicating apparatus described above, the construction and assembly of the parts may be simplified. Thereby minimization of the size of the indicating apparatus can be accomplished with considerable ease. Moreover, since a conductive adhesive agent is employed on many connecting portions inside, there is an advantage in that the working properties and the reliability of the device can be considerably improved. However, in manufacturing an indicating apparatus with such a construction, the grid 8 and cathode 9 are required to be installed respectively on the base plate in correct relationship with respect to each of the segmented electrodes 2*a*–2*h*. This brings about a problem in that, in assembling these electrodes, complicated and accurate tools are required and a considerable amount of labour is necessitated. Futhermore, in the described indicating apparatus printed terminals formed of conductive films deposited on the base plate are used as terminals for connecting outside circuits to the apparatus. Thus, complicated socket structures having resilient internal contacts are required for mating with these printed terminals. Such terminal connectors are expensive because of their construction which requires considerable precision.

SUMMARY OF THE INVENTION

It is therefore, an object of this invention to provide an indicating apparatus and a method for manufacturing the same which overcome the aforementioned conventional problems.

Briefly, this and other objects of the invention are achieved by providing a multi-digit fluorescent indicating apparatus, comprising an enclosure formed by sealingly attaching a base plate and an upper surface window plate. Segmented electrodes forming a plural digit pattern and consisting of a fluorescent material are disposed on the base plate. Grid terminal lead-in wires are integrally connected with each grid or spacer and cathode terminal lead-in wires are integrally connected with a cathode holder, and extend outside the sealed enclosure.

Further objects of the invention are achieved by the disclosed manufacturing method of the apparatus, and its related components.

BRIEF DESCRIPTION OF THE DRAWINGS

Further objects and advantages of this invention will become apparent from a reading of the following detailed description when considered in connection with the accompanying drawings, wherein.

DESCRIPTION OF THE PREFERRED EMBODIMENTS

Figure 1:
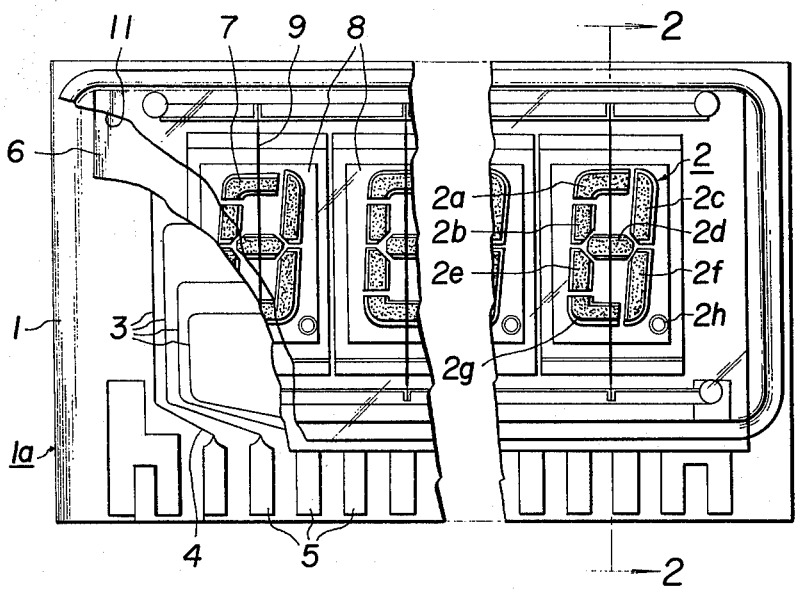
Fig. 1 PRIOR ART
FIG. 1 is a partially cutaway plan view of a conventional multi-digit fluorescent indicating tube.
Figure 2:
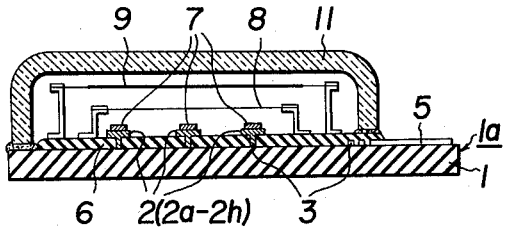
Fig. 2 PRIOR ART
FIG. 2 is a side view taken along 2—2 line of the conventional multi-digit fluroescent indicating tube of FIG. 1.
Figure 3:
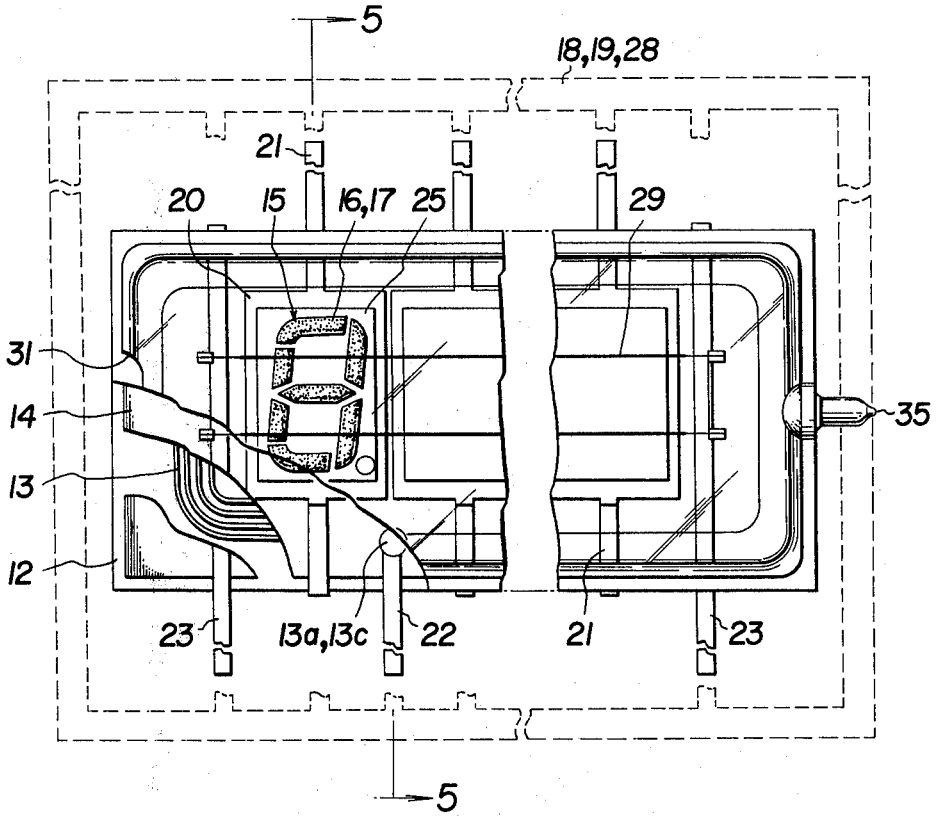
FIG. 3 is a partially cutaway plan view of an indicating apparatus according to one embodiment of the present invention.
Figure 4:
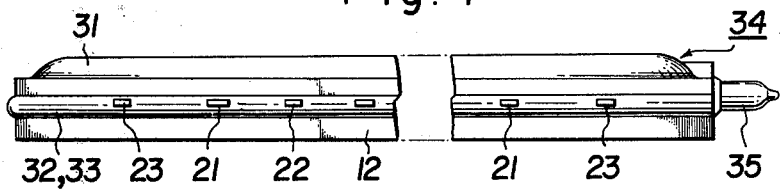
FIG. 4 is a side view of the embodiment of FIG. 3.
Figure 5:
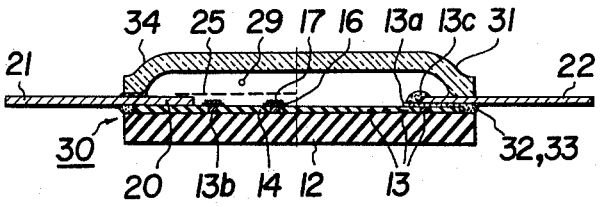
FIG. 5 is an end view taken along line 5—5 in FIG. 3.

Referring now to the drawings, wherein like reference numerals designate identical or corresponding parts throughout the several views, and more particularly to FIG. 3 thereof, the numeral 12 refers to a base plate made of insulating material, for example, glass or ceramic. On the upper surface of this base plate 12, plural wiring films or leads 13 electrically connecting each common segment electrode are disposed having an insulating film 14 interposed therebetween. The segmented electrode 16 and a fluorescent material 17 form plural number indicating portions 15 and are formed by sequential depositions. Connecting portion 13*a*, which is for connection with a segment terminal lead-in wire to be connected outside the enclosure, is provided on wiring film 13 through a small hole provided in the insulating film 14, and a connecting portion 13*b* with each segment electrode 16 is also provided through small hole on the said insulating film 14.

Figure 6:
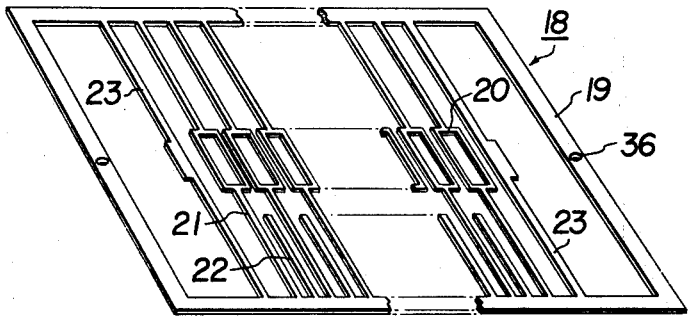
FIG. 6 is a perspective view of spacer frame.
Figure 7:
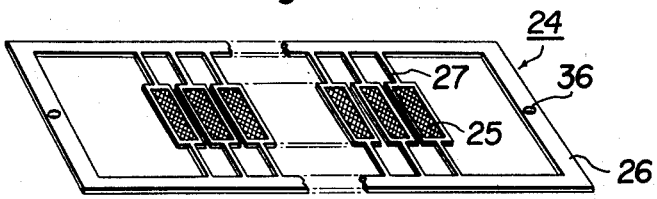
FIG. 7 is a perspective view of grid frame.
Figure 8:
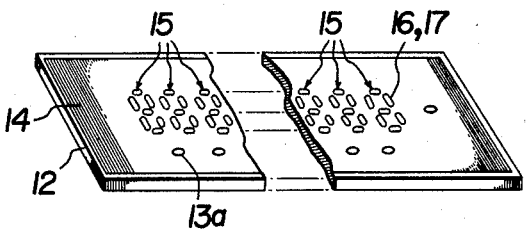
FIG. 8 is a perspective view of base plate.

Numeral 18 identifies a spacer frame formed as one body by means of punching or photo etching from a single metal plate. The frame 18, shown more clearly in FIG. 6, comprise a flat, rectangular shaped spacer holding frame 19 which is bigger than the base plate 12. Plural rectangular spacers 20 are disposed at regular intervals within the holding frame 19, and are of a size corresponding to the pattern indicating portion 15. Plural grid terminal lead-in wires 21, functioning also as parallel straight spacer holding pieces are provided, each with one end connected to the outer edge of the spacer 20 and the other end connected to the inner edges of holding frame 19. Plural segment terminal lead-in wires 22 are similarly provided, the base portions of which are connected to the holding frame 19 between each grid terminal lead-in wires 21, and the unconnected ends of which extend parallel with grid terminal lead-in wires 21 and are positioned so that connections can be made with each of the wiring films 13. A pair of left and right cathode terminal lead-in wires 23 are provided which are bridged in parallel with grid terminal lead-in wires 21 between the opposing inner edges of holding frame 19 at positions outside of the spacer 20. The wires 23 include holding portions for cathodes in the middles thereof.

In the spacer frame 18, the materials of at least each grid terminal lead-in wire 21, each segment terminal lead-in wire 22 and each cathode terminal lead-in wire 23 are formed of metal adapted for glass sealing composed of an alloy having almost the same thermal expansion coefficient as that of the base plate 12 and the upper surface window plate (described later), such as Fe-Ni-Co, Fe-Ni or Fe-Ni-Cr. It is extremely effective in shortening the manufacturing process to form the whole spacer frame 18 of a metal adapted for glass sealing, but depending upon materials available or convenience of operations, the spacer holding frame 19 and spacer 20 can, of course, be formed by other materials than a metal adapted for glass sealing, for example, Fe, Ni, Fe-Ni alloy or stainless steel and may be joined with the portion constructed of metal adapted for glass sealing by welding or other methods. Furthermore, in forming the spacer frame 18, for example, even when formed only of a metal adapted for glass sealing, plural segment terminal lead-in wires 22 formed separately can, of course, be combined into one body, by welding or another method, with spacer frame 18.

The size of each spacer 20 is set so that each pattern indicating portion 15 and each grid are disposed in a predetermined relationship. The shape of spacer holding frame 19 shown in the drawing is rectangular, but any desired shape can, of course, be used, for instance, U-shape, or other convenient shapes.

The numeral 24 designates a grid frame formed as one body from a single metal plate, and plural grids 25, each formed of mesh, are held in the central portion of a flat rectangular frame 26 oriented parallel to each other and with a predetermined spacing interval corresponding to the pattern indicating portions 15. The grids 25 are held in place by holding pieces 27 projecting from opposing inner edge portions of the grid frame. The grid frame 24 is preferably formed by a photo etching method employing a thin metal plate composed of a material such as stainless steel, Fe, Ni or Fe-Ni alloy.

Grid frame 24 is put over the spacer frame 18, formed as mentioned above, and after placing each grid 25 upon each spacer 20 and securing them by welding or caulking, electrode frame body 28 is formed by removing unnecessary portions, namely frame 26 and holding piece 27 combined to each grid 25.

In forming the aforementioned electrode frame body 28, as described above, a spacer frame 18 composed of plural spacers 20, plural grid terminal lead-in wires 21, segment terminal lead-in wires 22, cathode terminal lead-in wires 23, and the grid frame body 24 composing plural grids 25 in one body are combined. However the described example is not limiting and the electrode frame body may be formed by forming in one body the plural grids and grid terminal lead-in wires from one sheet or metal plate, separately forming into one body plural spacers and combining the grids and spacers. In another technique, the grids and spacers are not formed separately, but the electrode frame body may be formed by forming into one body spacers having a shape functioning as grids on the spacer frame body 18, and similarly the electrode frame body can be formed in various combinations.

Then, the electrode frame body 28 is placed on the upper surface of base plate 12 on which the pattern indicating portions 15 are formed. The electrode assembly base plate 30 and the electrode frame body 28 are joined into one body on base plate 12 by aligning spacers 20 and grids 25 with each pattern indicating portion 15, and electrically connecting and simultaneously adhering the edge portions of plural segment terminal lead-in wires 22 disposed on spacer frame body 18 to connecting portion 13*a* for each segmented electrode disposed on base plate 12 using the conductive adhesive agent 13c. To the cathode holding portion of cathode terminal lead-in wires 23 is secured a cathode 29, such as a direct heating oxide coated cathode formed by coating alkaline earth metal oxide material having good electron emission characteristics to a heater core of a material such as W wire.

The upper surface window plate 31, which is transparent at least in front of the pattern indicating portion 15 and made of glass for example, then mounted to the base plate 30. An enclosure 34 is formed by employing a sealing material 32, such as a low melting point glass frit, on the peripheral edges of the upper surface window plate and hermetically sealing the same by heating the sealing material.

An exhaust tube 35 is then mounted to permit evacuation of the enclosure 34. The exhaust tube 35 can be mounted and seated either before or after sealing of the enclosure 34, but it is desirable for simplification of the manufacturing process to seal it simultaneously with sealing of the enclosure. The attached position of the exhaust tube 35 is shown in the drawing as being positioned on one side of the apparatus between the base plate 12 and the upper surface window plate 31, although it can be located elsewhere. However, when the exahust tube 35 is provided in the proper position on the side as shown, the indicating apparatus thus formed becomes extremely thin and therefore it is extremely suitable for use in small electronic calculators.

Through the sealed portion 33 formed by applying the sealing material 32 around the periphery of the enclosure 34, are passed each grid terminal lead-in wire 21, each segment terminal lead-in wire 22 and the cathode terminal lead-in wire 23, all of which are provided in one body in the spacer frame body, and all are hermetically sealed. After this sealing operation, the spacer holding frame 19 and unused portions extending outside the attached portion 33 are suitably removed.

As described above, in predetermined related positions inside enclosure 34 each segmented electrode group 16 composing plural number pattern indicating portions, each grid 25 and cathode 29, are firmly disposed and secured. At the same time, electric conduction can be made from outside to each internal electrode through each segment terminal lead-in wire 22, each grid terminal lead-in wire 21 and the cathode terminal lead-in wire 23.

The upper surface window plate 31 covering enclosure 34 is of "boat shape" as shown in the figure, according to one embodiment of the present invention, but is not restricted to the aforementioned shape, since other shapes such as a flat plate shape or a circular boat shape can, of course, be employed.

In the aforementioned embodiment, plural grids 25 are formed on one sheet of the grid frame body 24 and are all connected to the frame 24. Of course, separately formed grids, each secured by welding to spacers 20 of spacer frame body may also be used.

Guide pin holes 36 on spacer frame 18 and grid frame body 24 may be provided for alignment.

In the aforementioned embodiment of the present invention, the terminal lead-in wires for each electrode are disposed on upper and lower portions of the base plate perpendicular to the longitudinal direction of the indicating apparatus. However, they can be disposed all in one direction perpendicular to the longitudinal direction of the indicating apparatus, or can be partially disposed in the longitudinal direction of the indicating apparatus, as desired.

Figure 9:
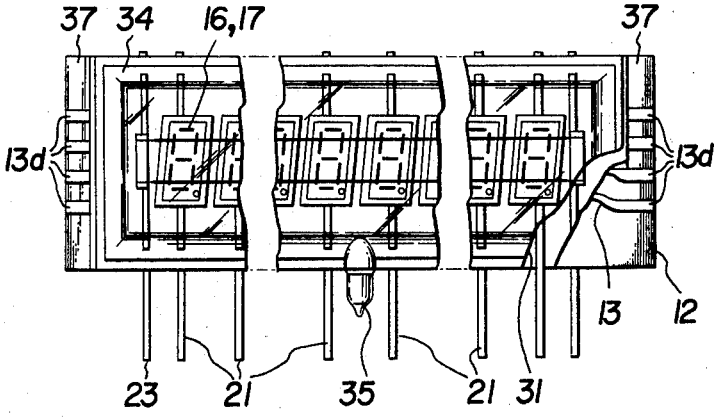
FIG. 9 is a partially cutaway view of another embodiment of indicating apparatus according to the present invention.

In the aforementioned embodiment of the present invention, connecting portion 13*a* connecting plural wiring films 13 provided on the upper surface of base plate 12 and segment terminal lead-in wires 22 are disposed inside the enclosure 34 comprising base plate 12 and upper surface window plate 31. In another embodiment shown in FIG. 9, each connecting portion 13*d* of plural wiring films 13 on base plate 12 is extended up to an edging portion 37 of base plate 12 forming an external printed terminal, and the connecting portion 13*d* may be disposed outside the enclosure 34. In this case, segment terminal lead-in wires passing through the sealing portion 33 attaching base plate 12 and upper surface window plate 31 are not necessiated, and each connecting portion 13*d* disposed on terminal 37 of base plate 12 is used as an external terminal for each segment electrode. In connecting the connecting portions 13*d* to an external circuit, each segment terminal wire (not shown in the figure) is simply connected to the external circuit directly by soldering for example.

In the aforementioned embodiment of the present invention, equipping the getter inside the indicating apparatus was not shown in detail, but it goes without saying that the getter can be disposed in any desired position inside the enclosure. Furthermore, in order to easily secure the getter in the indicating apparatus of this invention, a getter holding piece is provided in a sealing portion of the base plate and upper surface window plate and the getter can be secured to the getter holding piece. If such a getter holding piece is formed in advance in one body with the spacer frame body 18, mounting a getter can be carried out more easily.

In the aforementioned embodiment of this invention, the cathode 29 is disposed in the longitudinal direction of the indicating apparatus, but it can also be oriented in a direction perpendicular to the longitudinal direction.

Furthermore, cathode terminal lead-in wires 23 may be extended in printed form.

The indicating apparatus and manufacturing method thereof according to the present invention possesses the following various advantageous features because of the aforementioned construction and manufacturing process.

In the indicating apparatus according to the present invention, the base plate pattern forming portions function also as an enclosure, and terminal lead-in wires formed integrally with spacers and grids are used for most or all external terminals of each electrode instead of using printed wiring on the base plate. Therefore, there is an advantage in that the external size of the indicating apparatus, especially of the enclosure, can be minimized. Furthermore, in the indicating apparatus in which an exhaust tube is disposed on the side as shown in the FIGURES, the indicating apparatus can be made extremely thin providing an advantage in that a compact indicating apparatus is easily and suitably used especially in small portable calculators.

In the indicating apparatus according to the present invention, thanks to the enclosure constructed as previously described, the base plate and upper surface window plate providing most of the weight of the apparatus can be minimized in their weight, and thus multidigit indicating apparatuses having many indicating portions can be formed having extremely light weight.

The capability of minimizing the demensions and weight of the indicating apparatus is extremely advantageous in incorporating it into electronic calculators, and at the same time brings about a prominent effect in mass productivity and economization since the manufacturing facilities and jigs required especially in sealing, exhaust aging, and handling are simplified.

In production of the indicating apparatus according to the present invention, all spacers for grids for plural pattern indicating portions disposed in the indicating apparatus are formed in one sheet and are connected in predetermined positions by terminal lead-in wires. Therefore, an advantage is provided in that the spacers can be secured to the base plate in one operation. Therefore, complicated jigs and complicated operations necessiated in the production of conventional indicating apparatuses in which spacers and grids are secured to each pattern indicating portion provided on base plate together with aligning them can be simplified. Therefore, assemblying accuracy is improved and uniform quality can be obtained.

In the indicating apparatus according to the present invention, terminal lead-in wires formed in one body with spacers are used as external terminals and these terminal lead-in wires are hermetically sealed at the same time that the base plate and upper surface window plate are sealed by using a sealing material such as low melting point glass frit. Therefore, an advantage lies in that stems are not required and the number of internal connections can be minimized.

In the indicating apparatus according to the present invention, a base plate of the printed type is used by installing and disposing plural pattern indicating portions comprising plural segmented electrodes of coated fluorescent material together with connecting wiring films, insluting films and fluorescent material on the base plate, and it functions as an enclosure. However, printed wires are not employed as external terminals but terminal lead-in wires are used. As a result, when connection is made to an external circuit, expensive connectors for printed base plates are not required. Therefore, an advantage exists in that terminal lead-in wires for each electrode can be connected directly to the printed circuit board of an electronic calculator. Therefore, required space in electronic calculators for example, is minimized and a high degree of compactness as well as lightness can be obtained along with manufacturing economy.

Obviously, numerous modifications and variations of the present invention are possible in light of the above teachings. It is to be understood therefore that within the scope of the appended claims, the invention may be practiced otherwise than as specifically described herein.

What is claimed as new and desired to be received by Letters Patent of the United States is:

1. A method of manufacturing a multidigit fluorescent indicating apparatus comprising the steps of:

forming a base plate, formig a plurality of multiple digit indicating patterns consisting of a plurality of segmented electrodes having a fluorescent material deposited thereon on said base plate, forming an electrode frame body including a plurality of grid portions formed of spacers and grids, a plurality of grid terminal lead-in wires connected to said grid portions and a plurality of cathode terminal lead-in wires connected to cathode holders, said electrode frame body being formed as a unit, then placing said electrode frame body with respect to the base plate so that said indicating patterns are disposed between said base plate and said grid portions, securing a cathode to said cathode holders securing a transparent window plate over the assembled structure to form an enclosure, evacuating said enclosure; and, removing excess portions of said electrode frame body and lead-in wires which extend outside said enclosure.

2. A method as in claim 1, wherein said step of forming multi-digit indicating patterns includes the steps of:

depositing a plurality of film conductors to be connected to said segmented electrodes and segmented electrode lead-in wires on said base plate, depositing an insulating film for insulating said film conductors, except for the connecting portions thereof, on said base plate by lamination, depositing said segmented electrodes forming each of said multi-digit indicating patterns on said base plate by lamination, and depositing said fluorescent material on said segmented electrodes.

3. A method as in claim 2, further comprising the step of:

connecting each of said segmented electrode lead-in wires to said connecting portions of said film conductors.

4. A method as in claim 1, wherein said step of securing includes the step of:

passing said plurality of grid terminal lead-in wires, cathode terminal lead-in wires and segmented terminal lead-in wires through a sealed portion of said enclosure.

5. A method as in claim 1, wherein said step of forming said electrode frame body includes the step of:

forming said plurality of spacers, grid terminal lead-in wires connected to said spacers, said cathode holders, said cathode terminal lead-in wires connected to said cathode holders and said plurality of grid terminal lead-in wires from a single metal plate, forming said plurality of grids from a single metal plate, securing said grids to each of said spacers, and removing unnecessary portions of said grids.

6. A method as in claim 5, wherein said step of forming said spacers and grids includes the step of:

photo etching said spacers and said grids.

7. A method as in claim 4, wherein said step of securing includes the step of:

applying a low melting point glass frit around the periphery of said base plate and said transparent window plate; and, heating said glass frit so as to be melted whereby a heremetic seal is formed.

* * * * *